US005293805A

United States Patent [19]

Guardala et al.

[11] Patent Number: 5,293,805

[45] Date of Patent: Mar. 15, 1994

[54] MOUTHPIECE FOR SINGLE REED MUSICAL INSTRUMENTS

[75] Inventors: David S. Guardala; Jeffrey S. Powell, both of Hicksville, N.Y.

[73] Assignee: Dave Guardala Mouthpieces, Inc., New York, N.Y.

[21] Appl. No.: 818,556

[22] Filed: Jan. 9, 1992

[51] Int. Cl.[5] ..... G10D 9/02

[52] U.S. Cl. ..... 84/383 R

[58] Field of Search ..... 84/383 R, 383 A, 380

[56] References Cited

U.S. PATENT DOCUMENTS 4,991,483 2/1991 Petit ..... 84/383 R

*Primary Examiner*—Michael L. Gellner
*Assistant Examiner*—Cassandra Spyrou
*Attorney, Agent, or Firm*—Charles E. Temko

[57] ABSTRACT

An improved mouthpiece for use with single reed woodwinds to enable the generation of improved sound quality from the standpoint of enhanced harmonic tone generation. The configuration of the mouthpiece in the area overlying the opening which underlies the vibrating end of the reed is significantly modified relative to prior art construction to enable the reed to vibrate a column of inducted air as the same passes through a relatively narrow channel, following which the column enters a channel of substantially greater cross-section before exiting to the neck of the instrument. As contrasted with the prior art construction in which the area immediately above the vibrating portion of the reed defines an air column of greater cross-section, the constricting of the column at the point in which vibration is imparted generates additional harmonics which significantly affect the quality of the tone. The cross-sectional area of the channel is substantially enlarged by modifying the area from circular to elliptical shape resulting in a configuration which is higher than it is wide prior to communicating with the neck or tuning barrel of the instrument.

3 Claims, 1 Drawing Sheet

FIG. 1
PRIOR ART
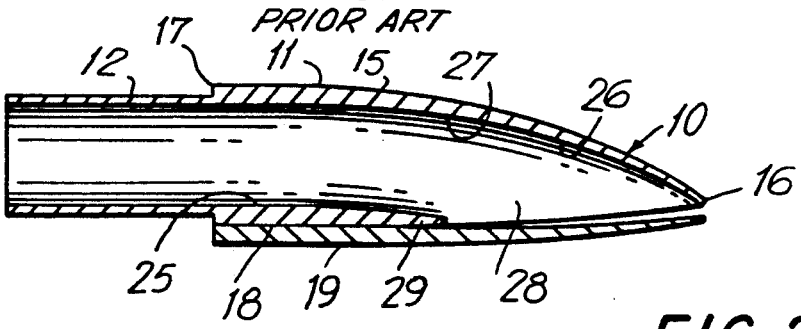
FIG. 2
PRIOR ART
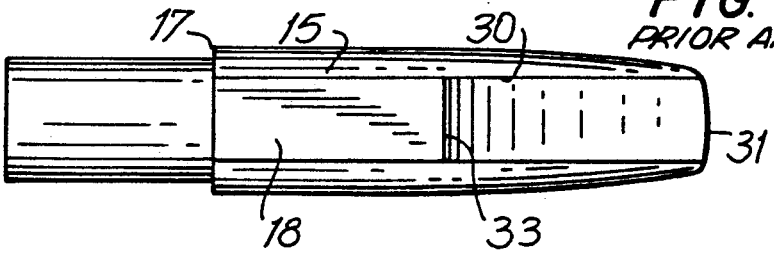
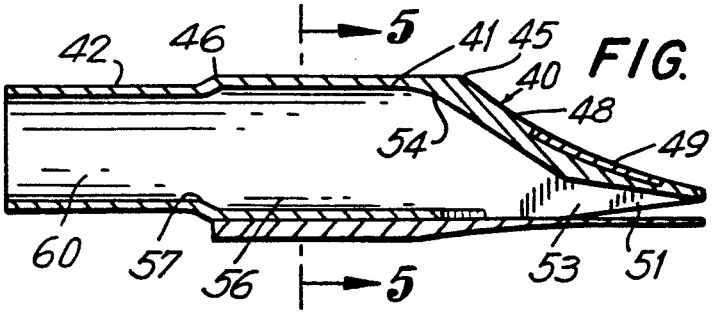
FIG. 3
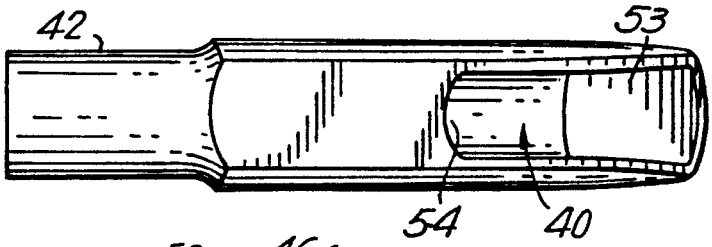
FIG. 4
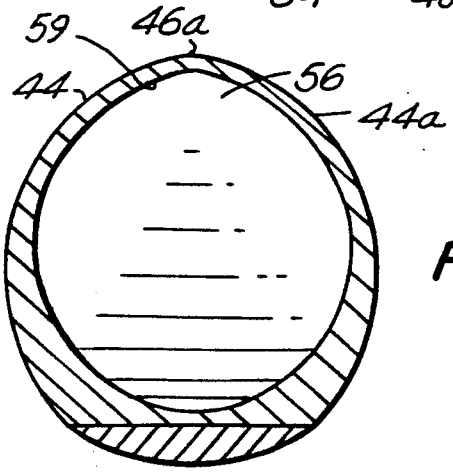
FIG. 5

MOUTHPIECE FOR SINGLE REED MUSICAL INSTRUMENTS

BACKGROUND OF THE INVENTION

This invention relates generally to the field of woodwind musical instruments, and more particularly to those which employ a single reed to vibrate a column of air which passes through the barrel of the instrument to exit at tone openings therealong.

As contrasted with string instruments which naturally develop multiple harmonic vibrations, the degree to which the woodwind family possesses this capability is far more limited. In the case of the flute, this instrument, which has no reed, is capable of generating substantially only a pure tone, which for all practical purposes, is devoid of harmonic overtones. The double reed instruments, such as the oboe, bassoon, are capable of producing tones having a substantial degree of harmonics, and the artist often varies this quality to his preference by the simple expedient of shaping the reed to corresponding configuration. The reeds for such instruments are normally sold in unfinished condition to enable such shaping.

In the case of single reed instruments, such as clarinets and saxophones of varying tone ranges, the mouthpiece is provided with an opening lying in a plane disposed at a small angle with respect to the principal axis, and a terminal end of the reed overlies the opening. The opposite end of the reed is rigidly clamped to the mouthpiece at a point beyond the distal end of the opening. The vibrating end of the reed is relatively broad and flat. The resultant tonal quality, as compared with the double reed family is substantially less shrill, and vibration is enhanced by a greater volume of air with somewhat less effort on the part of the player. The generation of harmonics, particularly in the lower tonal ranges, however, is not substantial, being superior to the flute, and considerably inferior to the corresponding double reed instruments. This problem is of particular importance where the instrument is used in a solo performance.

SUMMARY OF THE INVENTION

Briefly stated, the invention contemplates the provision of an improved mouthpiece of the single reed type the use of which permits the production of a superior tone quality which may be readily distinguished from that normally produced by a conventional instrument. This result is accomplished by varying the shape and dimensions of critical areas to enable the generation of overtones without modification of the reed, and without requiring any substantive modification of the playing technique of the artist. This is accomplished in large measure by providing a mouthpiece in which the traditional medially positioned cross-sectional configuration is modified to that defined by a pair of intersecting curves radius resulting in the mouthpiece having a substantially greater height than width with correspondingly shaped interior passages. Additionally, the area along the vibrating end of the reed is substantially narrowed in height to form a relatively flat channel within which the vibrating column of air is generated, the flat channel gently merging with the enlarged longitudinally directed channel which overlies the clamped end of the reed.

BRIEF DESCRIPTION OF THE DRAWINGS

In the drawings, to which reference will be made in the specification, similar reference characters have been employed to designate corresponding parts throughout the several views.

FIG. 1 is a vertical longitudinal central sectional view of a conventional single-reed mouthpiece in accordance with the prior art.

FIG. 2 is a bottom plan view thereof.

FIG. 3 is a central longitudinal sectional view of a single-reed mouthpiece embodying the present invention.

FIG. 4 is a bottom plan view thereof.

FIG. 5 is a transverse sectional view as seen from the plane 5—5 in FIG. 4.

DETAILED DESCRIPTION OF THE DISCLOSED EMBODIMENT

Before entering into a consideration of the preferred embodiment of the invention, a consideration may be given to the prior art traditional mouthpiece illustrated in FIG. 1 in the drawing. The prior art mouthpiece generally indicated by reference character 10 is normally molded from hard rubber or similar material to include a generally conical body 11 having a cylindrically shaped shank 12. The body 11 is bounded by a conical outer surface 15 extending from a proximal end 16 to a distal end 17 which merges with a generally planar surface 18 against which a vibrating reed 19 is clamped. Interiorly of the body 11 is a centrally aligned bore 25 having a forward wedge-shaped portion 26 bounded by a curved upper wall 27, generally planar side walls, one of which is indicated by reference character 28, and a relatively short curvilinear lower wall 29. The bore 25 terminates in a generally trapezoidally shaped opening 30 extending from a first end 31 to a second end 33. The mouthpiece is generally circular in cross-section except for the proximal end 16 which engages the mouth of the user.

In the above construction, the column of vibrating air overlying the reed is relatively large in cross-sectional area, and is substantially larger than that of the axially aligned bore with which it communicates. This construction accounts in relatively large measure for the traditional tone quality generated by the single reed instruments, such as clarinets and saxophones which is substantially less shrill than that of the double reed instruments such as the oboe and bassoon. While rather mellow, such tone substantially lacks the presence of overtones which impart a fuller sound which is experienced, for example, upon listening to a reed stop of a pipe organ. We have determined that this lack of character is principally due to the lack of surfaces within the conventional mouthpiece which will constrain the air column adjacent the point of generation, i.e., immediately above the reed, which is normally present between the opposing surfaces of the reeds in the case of a double-reed mouthpiece.

We have developed earlier constructions which are known in the art, which have attempted to resolve this problem by narrowing the mouthpiece chamber at the area overlying the inner surface of the reed. These efforts have produced a relatively flat channel which abruptly merged with an area similar to that shown in FIG. 1 in the drawing at a point approximately 1" from the proximal end of the mouthpiece. This simple expedient has created a somewhat fuller tone at the expense of unacceptable harshness which has destroyed the normally mellow quality characteristic of the single reed family of instruments.

With the foregoing discussion in mind, reference may now be made to FIGS. 3 and 4 in the drawing which illustrates a preferred embodiment of the invention.

The device, generally indicated by reference character 40, includes a main body 41 of generally non-circular cylindrical configuration, and a cylindrical shank 42. The main body 41 is bounded by a pair of elliptical surfaces 44 and 44*a* extending from a first point 45 to a second point 46. The surfaces meet in point 45 is a generally triangularly-shaped member 48, including a relatively flat upper wall 49 and a pair of converging side walls, one of which is indicated by reference character 51 which are extensions of the surfaces 44 and 44*a*. The inner surface of the upper wall 49 terminates in a gently rounded distal end 54, while the side walls 51 continue rearwardly. These walls form a triangularly shaped recess 53 which immediately overlies the vibrating reed. The inner surfaces of this recess form a relatively small cross-sectional area, wherein the vibrating column of air strikes these inner surfaces to result in the generation of fuller harmonic 54 overtones.

The larger distal end of the recess 53 merges with a longitudinally oriented, substantially elliptically shaped bore 56 (See FIG. 5), the axis of which is parallel with the principal axis of the main body, the edges defining the plane of merging being gently rounded at 57 so as to avoid the generation of any turbulence which would be detrimental to sound quality thus, the medially positioned cross-sectional configuration shown in FIG. 5 is substantially ovoid.

The upper portion of the bore 56, in turn, forms a longitudinally oriented radius 59 which leads to the central bore 60 of somewhat smaller diameter which extends through the shank 42.

It will be observed that the above construction creates an air column passage in which the column of vibrating air in the area adjacent the vibrating reed is quite shallow, which area communicates with a substantially larger area of generally elliptical shape disposed substantially parallel to the axis of the mouthpiece which, in turn, leads to the main cylindrical passage within the neck or tuning barrel of the instrument (not shown). The initiation of the vibrating column of air in the narrow passage causes the generation of multiple harmonic overtones, and the gradual enlargement of the passage, in the absence of sharp edges from that point to the point of communication with the instrument enables these harmonic overtones to be transmitted in the absence of any unwanted turbulence which would distort the same shortly after formation. The end result is the preservation of the mellow tone for which the single instruments are noted, with deeper sound quality caused by the addition of the harmonics.

In playing an instrument using a mouthpiece embodying the invention, we have found that very little additional blowing force is required, since the area above the reed is approximately half of the corresponding area in the prior art construction, thus avoiding the narrow constriction characteristic of double-reed instruments. By eliminating sharp corners, over which the air column must flow, no unwanted turbulence is provided at the periphery of the air column, so that the generated overtones are undistorted with passage of the column of air through the mouthpiece.

We wish it to be understood that we do not consider the invention to be limited to the precise details of structure shown and set forth in the specification, for obvious modifications will occur to those skilled in the art to which the invention pertains.

We claim:

1. An improved mouthpiece for single reed musical instruments comprising a generally elliptically-shaped main body having a principal longitudinal axis and having proximal and distal ends; a hollow cylindrical shank extending from said distal end for engagement with the neck of a related musical instrument; said main body including a tapered member of triangular shape including an upper wall and a pair of opposed side walls for engagement between the lips of a user and terminating at said proximal end; said member including a planar lower surface for supporting a reed, said surface defining an elongated opening leading to a hollow interior of said mouthpiece; said upper wall and opposed side walls of said tapered member forming an inner surface defining a triangularly shaped recess above said opening which tapers toward said proximal end; said main body defining an elliptically-shaped longitudinally-oriented bore, said triangularly-shaped recess merging with a first end of said elliptically-shaped bore with absence of sharp edges to minimize turbulence; said cylindrical shank having an axially disposed cylindrical bore therein, a proximal end of which communicates with the distal end of said elliptically-shaped bore, said elliptically-shaped bore having a cross-sectional area greater than that of said bore in said shank, and forming a transitional surface at an area of communication therewith; whereby a vibrating column of air passing through said mouthpiece initiates in an area of relatively small cross-section, to facilitate generation of harmonic overtones, the column of air thereafter entering said elliptically-shaped bore without substantial turbulence, and flowing thereafter to said bore to said shank.

2. An improved mouthpiece in accordance with claim 1, further characterized in said main body being bounded by a pair of curved outer surfaces which intersect in a line parallel to the principal axis of said mouthpiece at upper edges of said surfaces.

3. An improved mouthpiece in accordance with claim 1 in which said main body has a medially positioned cross-sectional configuration of greater height than width.

* * * * *